United States Patent [19]

Ernst

[11] 3,995,903

[45] Dec. 7, 1976

[54] ENGINE LIFT TOOL

[75] Inventor: James Edward Ernst, Bellevue, Iowa

[73] Assignee: Deere & Company, Moline, Ill.

[22] Filed: Aug. 18, 1975

[21] Appl. No.: 605,470

[52] U.S. Cl. ..... 294/81 R; 294/78 A

[51] Int. Cl.[2] ..... B66C 1/10

[58] Field of Search ..... 294/67 R, 67 AA, 67 B, 294/67 BB, 67 D, 67 DA, 78 A, 78 R, 81 R, 81 SF, 82 AH, 86 LS; 214/86 A, 730; 248/323, 339; 254/133 R, 134

[56] References Cited

UNITED STATES PATENTS

| | | | |
|---|---|---|---|
| 2,368,947 | 2/1945 | Smith | 294/78 A |
| 2,905,501 | 9/1959 | Jakubowski | 294/81 R |

FOREIGN PATENTS OR APPLICATIONS

| | | | |
|---|---|---|---|
| 488,327 | 11/1952 | Canada | 294/81 R |
| 809,070 | 2/1937 | France | 294/81 R |

*Primary Examiner*—Johnny D. Cherry

[57] ABSTRACT

An engine lift tool, as considered in a normal upright working position, includes a yoke member having inverted U-shaped bails or lift members supported on the opposite ends thereof. The respective undersides of the bail members are provided with a plurality of notches which engage the yoke member to hold the bails in adjusted transverse positions relative to the yoke member and a lifting ring encircles the yoke member and is movable longitudinally thereof for engagement with a plurality of notches provided along its underside. The yoke member, bail members and lifting ring are constructed so as to be inseparable one from the other.

4 Claims, 4 Drawing Figures

ENGINE LIFT TOOL

BACKGROUND OF THE INVENTION

The present invention relates to an engine lift tool and more particularly relates to an engine lift tool of a type including lift bails or brackets adapted for being bolted onto an engine and connected to a yoke member which is in turn adapted for connection to a lift hoist or the like.

Known engine lift tools of the type described in the preceeding paragraph normally include various parts which are separable one from the other and which must be disassembled and then reassembled to adjust the lift tool to accommodate engines having different weight distributions. Such disassembly and assembly is time consuming and an operator may leave the lift tool in a disassembled state resulting in parts of the tool becoming misplaced or lost.

SUMMARY OF THE INVENTION

According to the present invention, there is provided a novel engine lift tool.

An object of the invention is to provide an engine lift tool which retains the adjustability of the prior art devices but is constructed in such a way that its parts are inseparable one from the other.

A more specific object of the invention is to provide an engine lift tool including a yoke member having openings provided at its opposite ends which respectively receive bright portions of inverted U-shaped engine lift members or bails, the latter being dimensioned such that they may not be removed from the openings.

A further object is to provide lift members or bails which may be adjusted transversely of the yoke member without requiring any disassembly.

Another specific object is to provide a lifting ring which encircles the yoke member and is adjustable lenghtwise thereof without requiring any parts to be disassembled and then reassembled.

These and other objects will become apparent from a reading of the following description taken in conjunction with the appended drawings.

DESCRIPTION OF THE PREFERRED EMBODIMENT

Figure 1:
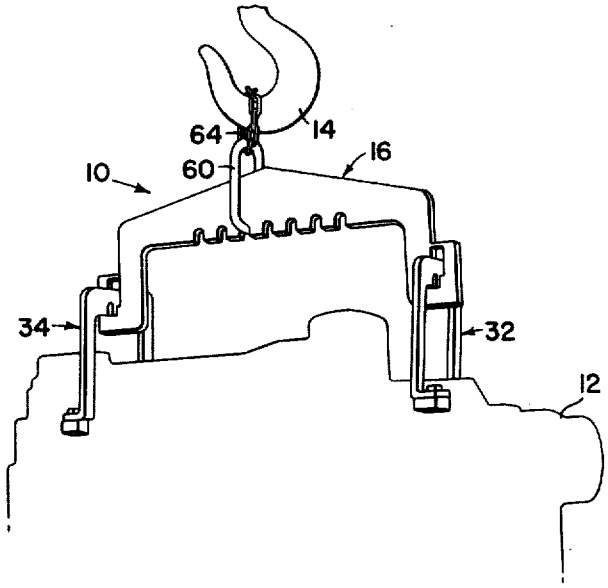
FIG. 1 is an overall perspective view showing the engine lift tool connected to an engine having only its outline shown.
Figure 2:
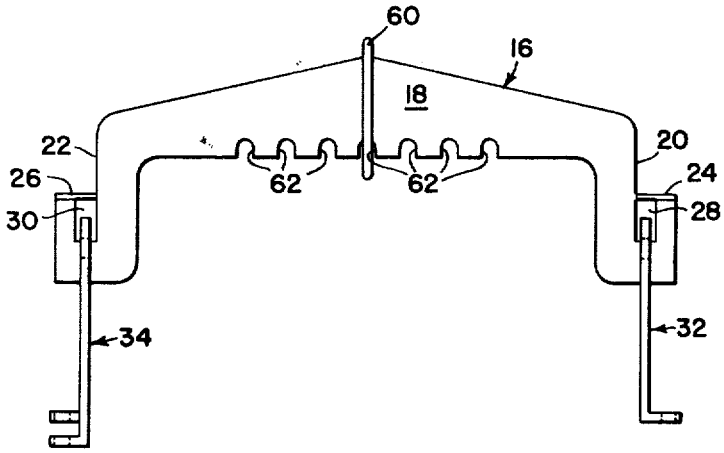
FIG. 2 is an elevational view showing one side of the engine lift tool.

Referring now to FIG. 1, therein is shown in operating relationship the combination of an engine lift tool 10 connected to an engine 12 and having a hook 14 of a hoisting device connected thereto. As viewed in its operating position shown in the drawings, the tool 10 includes a yoke member 16 fashioned from a flat plate having a central portion 18 extending between right and left hook-shaped ends 20 and 22, respectively, having upwardly openings throats which are closed by pieces 24 and 26 which are welded thereacross. The pieces 24 and 26 thus respectively cooperate with the right and left ends 20 and 22 to form openings 28 and 30 extending transversely to the length of the member 16.

Figure 4:
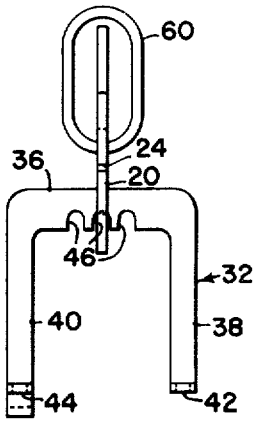
FIG. 4 is a right end view of the engine lift tool shown in FIG. 2.

Respectively mounted in the openings 28 and 30 are inverted U-shaped bail or lift members 32 and 34. Specifically, the member 32 includes a bight portion 36 received in the opening 28 and joining, as viewed in FIG. 4, right and left legs 38 and 40 which respectively terminate in outwardly apertured mounting tabs 42 and 44. Provided along the underside of the bight portion 36 are a plurality of notches 46 which are dimensioned for receiving an edge of the yoke member 16 bounding a lower portion of the opening 28, the notches 46 serving to hold the member 32 in a desired transverse position to the yoke member 16.

Figure 3:
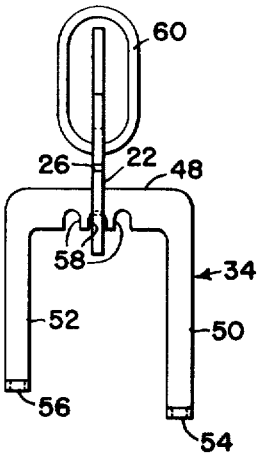
FIG. 3 is a left end view of the engine lift tool shown in FIG. 2.

Similarly, the member 34 includes a bight portion 48 received in the opening 30 and connecting, as viewed in FIG. 3, right and left legs 50 and 52 which respectively terminate in lower out turned ends defining aperatured mounting tabs 54 and 56. Provided in the underside of the bight portion 36 are a plurality of notches 58 dimensioned for receiving an edge of the member 16 bounding a lower portion of the opening 30 so as to retain the member 34 in an adjusted transverse position relative to the yoke member 16.

A lift ring 60 encircles the central portion 18 of the yoke member 16 and is received in one of a plurality of notches 62 formed in the underside of the central member 18 for holding the ring 60 in an adjusted longitudinal position relative to the yoke member 16. A length of chain 64 is here shown in connecting relationship between the ring 60 and the lift hook 14.

The operation of the lift tool 10 is as follows. In order to lift an engine, the hoisting device is moved to a position wherein the lift tool 10 is suspended above the engine 12. It is then lowered a sufficient amount for the bail or lift members 32 and 34 to be bolted to the engine by inserting bolts through the apertured mounting tabs 42 and 44 of the member 32 and through the apertured mounting tabs 54 and 56 of the member 34. The hoisting device is then raised so as to engage the opposite ends of the yoke member 16 with one of the notches 46 of the bail or lift member 32 and with one of the notches 58 of the bail or lift member 34. If the engine tips sideways, an uneven weight distribution in the sideways direction is indicated and to remedy this problem the operator needs only to lower the hoist sufficiently to disengage the yoke member 16 from the notches 46 and 58 and to dispose the yoke member 16 such that it will engage an appropriate one of the notches 46 and 58 before again lifting the engine.

If the engine should tilt from end to end when it is raised by the hoisting device, an uneven weight distribution in the fore-and-aft direction is indicated and to rectify this situation the operator needs only to slack the hoisting device and move the lift ring 60 in the appropriate direction to engage another one of the notches 62 so that a more even lifting condition is obtained.

It will be appreciated, that since the mounting tabs 42 and 44 of the member 32 are dimensioned such that they will not pass through the opening 28 and that the mounting tabs 54 and 56 of the member 34 are dimensioned such that they will not pass through the opening 30, the members 32 and 34 are inseparable from the yoke member 16; and also, since the lift ring 60 cannot be removed from the yoke member 16 once the bail or lift members 32 and 34 are installed it will be appreciated that the ring is inseparable from the yoke member 16. Thus, with the yoke member 16, bail members 32 and 34 and the lift ring 60 being inseparable from one another, there is no likelihood that these parts will be misplaced or lost.

I claim:

1. An engine lift tool, comprising: an elongate yoke member having opposite first and second end portions respectively defining first and second extending transversely to the length of the yoke member; first and second inverted U-shaped lift brackets having respective bight portions respectively shiftably mounted in said first and second openings; said first and second lift brackets being dimensioned suct that it is impossible to remove them from said first and second holes; each of said first and second lift brackets including first and second legs respectively having end portions which are generally horizontally disposed when the first and second openings are located substantially at the same level; and said end portions being provided with vertical apertures for receiving fasteners for securing the first and second brackets to an engine and said end portions being dimensioned too large to pass through the first and second openings.

2. The tool defined in claim 1 and further including a one-piece lift ring encircling said yoke member at a location between the opposite first and second ends thereof; and said lift ring being dimensioned so as to form an inseparable assembly with the yoke member and lift brackets.

3. The tool defined in claim 1 wherein the respective bight portions of the first and second lift brackets have a plurality of downwardly facing notches formed along a lower surface thereof; and ssaid first and second openings each having a lower portion thereof bounded by an edge dimensioned complimentary to said notches.

4. The tool defined in claim 3 and further including a one-piece lift ring loosely encircling said yoke member at a central portion thereof extending between said first and second end portions; said lift ring being dimensioned so as to prevent its removal over the lift brackets; and an underside portion of said central portion being provided with a plurality of downwardly opening notches dimensioned for receiving said lift ring.

* * * * *

UNITED STATES PATENT OFFICE

CERTIFICATE OF CORRECTION

Patent No. 3,995,903 Dated 7 December 1976

Inventor(s) James Edward Ernst

It is certified that error appears in the above-identified patent and that said Letters Patent are hereby corrected as shown below:

Column 3, line 10, after "second" insert --openings--.

Column 3, line 15, change "suct" to --such--.

Column 4, line 12, change "ssaid" to --said--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*